US006779440B2

(12) United States Patent
Pekka et al.

(10) Patent No.: US 6,779,440 B2
(45) Date of Patent: Aug. 24, 2004

(54) METHOD AND DEVICE CHANGING THE VAPOR PRESSURE INSIDE THE PAPER WEB IN CALENDERING

(75) Inventors: Koivukunnas Pekka, Järvenpää (FI); Hannamari Härkönen, Järvenpää (FI); Risto Talja, Vaajakoski (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/203,571

(22) PCT Filed: Feb. 1, 2001

(86) PCT No.: PCT/FI01/00090

§ 371 (c)(1),
(2), (4) Date: Oct. 29, 2002

(87) PCT Pub. No.: WO01/59211

PCT Pub. Date: Aug. 16, 2001

(65) Prior Publication Data

US 2003/0110959 A1 Jun. 19, 2003

(30) Foreign Application Priority Data

Feb. 11, 2000 (FI) ..... 20000288

(51) Int. Cl.[7] ..... B30B 15/34
(52) U.S. Cl. ..... 100/38; 100/306; 162/206
(58) Field of Search ..... 100/38, 74, 92, 100/155 R, 161, 302, 331, 306–308; 162/205–207, 358.3, 358.4, 360.2

(56) References Cited

U.S. PATENT DOCUMENTS

| | | | | |
|---|---|---|---|---|
| 5,033,373 | A | 7/1991 | Brendel et al. | |
| 5,524,532 | A | 6/1996 | Koivukunnas et al. | |
| 5,566,472 | A | 10/1996 | Lehtinen et al. | |
| 5,649,478 | A | 7/1997 | Chadha | |
| 5,750,259 | A | 5/1998 | Neider et al. | |
| 6,397,739 | B1 | 6/2002 | Viljanmaa | |
| 6,475,342 | B1 * | 11/2002 | Retulainen | 162/206 |

FOREIGN PATENT DOCUMENTS

| | | |
|---|---|---|
| EP | 0 349 202 A2 | 1/1990 |
| FI | 54514 | 8/1978 |
| WO | WO 98/44195 | 10/1998 |
| WO | WO 01/59211 A1 | 8/2001 |

OTHER PUBLICATIONS

International Preliminary Examination Report issued in PCT/FI01/00090.
International Search Report issued in PCT/FI01/00090.

* cited by examiner

*Primary Examiner*—Allen Ostrager
*Assistant Examiner*—Jimmy T Nguyen
(74) *Attorney, Agent, or Firm*—Stiennon & Stiennon

(57) ABSTRACT

In the method for calendering a paper or paperboard web, the properties of a paper or paperboard web (W) are modified by changing the vapour pressure inside a moist paper or paperboard web. The device for calendering a paper or paperboard web comprises means for changing the vapour pressure inside the moist paper or paperboard web (W).

12 Claims, 1 Drawing Sheet

METHOD AND DEVICE CHANGING THE VAPOR PRESSURE INSIDE THE PAPER WEB IN CALENDERING

CROSS REFERENCE TO RELATED APPLICATIONS

This application is a US national stage application of PCT Application No. PCT/FI01/00090, filed Feb. 1, 2001, and claims priority on Finnish Application No. 20000288 filed Feb. 11, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method and device in calendering. The method involves the calendering of a paper or paperboard web in such a manner that after the treatment the web has a smooth surface and a bulky structure. The device is arranged to implement the aforementioned method.

Typically, calenders comprise superimposed rolls, between which a nip is formed. A calender can comprise one or more roll pairs forming a nip. The rolls may be unheated or heated, and they can have a hard or soft surface. The web travels via the nips along a winding path, and by means of this treatment, for example, the variations in the thickness of the web are reduced, the surface becomes smoother and the web becomes thinner.

U.S. Pat. No. 5,524,532 discloses a method and apparatus for calendering a surface of a paper or board web. A temperature difference is created between the web surfaces so that the surface to be calendered is cooler than the opposite surface. Moisture within the web is transferred towards the cooler surface while substantially preventing evaporation of moisture from the web so as to create a predetermined moisture profile. The web having a predetermined moisture profile is advanced into the calendering nip so that the relatively cooler and moister surface of the web is pressed against the heated roll of the nip to thereby calender that web surface.

U.S. Pat. No. 5,649,478 discloses a machine calender by means of which a smooth surface and a bulky structure is attained for the paper or paperboard. Before the nip, moisture is sprayed on the transfer rolls of the machine calender, the moisture being shifted to the web in the nip.

U.S. Pat. No. 5,750,259 discusses the finishing of the web by means of a hot calender roll and a smooth-faced belt, which form a soft nip. The web becomes smooth and glossy.

WO 98/44195 discusses the calendering of a web by means of a device which is arranged to form a long nip. On both sides of the web to be calendered there is a mirror-symmetrical arrangement in which an endless belt preferably made of metal travels around a soft-faced and a hard-faced roll. The soft-faced rolls on both sides of the web form a nip via which the web travels. One embodiment of the invention disclosed in the publication (FIG. 4 in the publication) is a device in which hard-faced rolls also form a nip. In the nip formed by the hard-faced rolls it is also possible to use a very strong press, which corresponds to the effect produced by the machine calender. After the nip formed by the hard-faced rolls, the belts travelling on both sides of the web support the web in such a manner that the web does not bend, said bending being a problem when high press pressures are used. The web travels between the belts to a nip formed by the soft-faced rolls, which nip is longer than the nip formed by the hard-faced rolls, and the pressure is smaller therein. In this nip a glazing result similar to the one attained when using a soft calender is obtained on both surfaces of the paper.

There are situations in which the thinning of the web is not desired in connection with the calendering. In some applications, for example in printing papers, bulky paper with a smooth surface is required. Paper which has dense, smooth outer surfaces and is bulky in the area between the surfaces is stiff, which is a good quality in many applications.

SUMMARY OF THE INVENTION

By means of the method and device according to the invention it is possible to produce smooth, bulky paper or paperboard. The method is characterized in that the moist paper or paperboard web travelling under a slight external pressing pressure through a long nip formed between two smooth, moisture impermeable counter surfaces from which at least one is heated, and a first surface of the web is in contact with the first counter surface and a second surface of the web is in contact with the second counter surface, the first counter surface having a first temperature of at least 100° C. and the second counter surface having a second temperature of at least 160° C., in such a way that the second surface of the web is calendered during travelling between the counter surfaces by the contact with the second counter surface and that the inner vapour pressure inside the moist paper or paperboard web is increased due to the heating of the web and the restriction of the evaporation of moisture from the web by means of the counter surfaces, said inner vapour pressure resisting the slight pressing pressure between the smooth counter surfaces thus counteracting reduction of the thickness of the web during calendering. The device according to the invention is characterized in that it is arranged to carry out the above mentioned method.

By means of the method and device according to the invention it is possible to attain an advantageous smoothness of the surface in such a manner that even in the worst case, the bulkiness is only slightly reduced. Among other things, the product attained by means of the method and device has the advantage that it absorbs printing ink evenly, and it has a flexible structure in such a manner that a good contact is attained between the printing cylinder and the paper. By installing the devices successively, it is possible to treat both sides of the web.

Before calendering, the web is produced by means of a known method and device. In the calendering method according to the invention, a moist paper or paperboard web travels between smooth counter surfaces in such a manner that a substantial external loading is not exerted on the web. The smooth counter surfaces form a long nip which is only slightly loaded externally, the loading of the nip being constant on the entire length of the nip. The counter surfaces are made of moisture impermeable material and they restrict the evaporation of moisture from the web. The first counter surface is heated to a given temperature T1 and the second counter surface to a given temperature $T_2$, wherein the temperature $T_2$ is higher than $T_1$. Because the space between the counter surfaces is substantially closed, steam starts to flow towards the counter surface which is in a lower temperature, said temperature being $T_1$. Thus, the steam produced on the hotter surface in connection with drying shifts towards the lower pressure, i.e. towards the counter surface which is in a lower temperature. In order to produce vapour pressure, it is required that the temperature T1 is at least 100° C. The surface of the web becomes smooth in the contact against the hotter counter surface. Against the counter surface in the lower temperature a pressure is exerted, said pressure resisting the pressing pressure between the smooth counter surfaces. Advantageously, the inner vapour pressure is allowed to be reduced in the contact against the smooth counter surface, wherein a slow and controlled reduction of the vapour pressure is attained inside the paper. Thus, it is ensured that the surface of the paper remains smooth, and fibres are not discharged from the surface of the web. The web is in a direct contact with both counter surfaces without a wire therebetweeen, which wire would cause markings on the web. The surface roughness of the smooth counter surfaces is advantageously $R_a$ =0.1–0.4 mm. After the calendering treatment the web is dried further, if necessary, and thereafter the web is possibly reeled.

The method according to the invention can also be used for placing additives on the surface of the web. Pigments of suitable particle size and/or fines are conveyed on the surface of the web by means of inner vapour pressure, wherein they fill the spaces between the fibres and/or pores of the fibres. Thus, the paper is in a way coated from inside. The method according to the invention can also be combined to multi-layer forming, wherein the raw material composition of the surface layers can be optimized to attain an even and smooth surface structure. In multi-layer forming, pigments and/or fines can advantageously be placed only on the surface layer.

The high temperature required in the method can be attained for example by means of known thermoroll technique, or by means of a hot drying cylinder. Advantageously, the treatment is conducted by means of a device according to the invention, in which smooth counter surfaces are heated by methods known as such.

BRIEF DESCRIPTION OF THE DRAWINGS

In the following, the invention will be described by means of examples and with reference to the appended drawings, in which.

DESCRIPTION OF THE PREFERRED EMBODIMENTS

Figure 1:
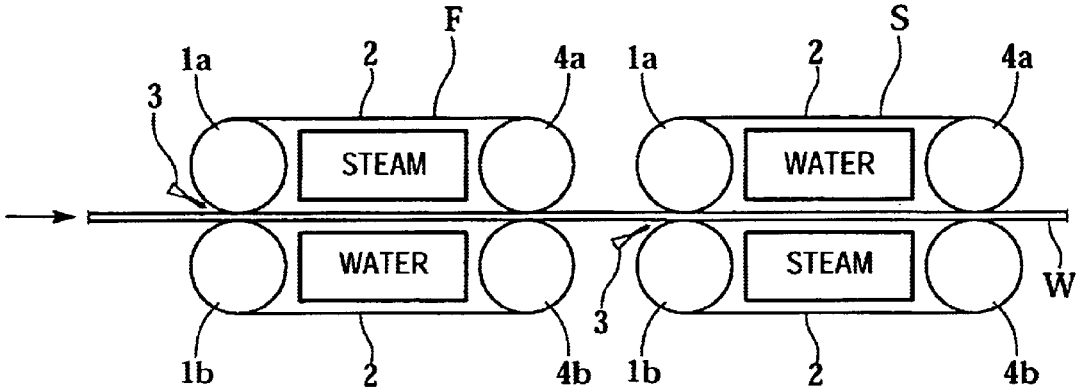
FIG. 1 shows an elementary side-view of an embodiment for a device according to the invention (the drawing is not in perspective)

According to FIG. 1, web W travels substantially on the horizontal plane through a first device F, which comprises rolls 1*a*, 1*b*, 4*a* and 4*b*. Structurally, the rolls 1*a*, 1*b*, 4*a* and 4*b* are advantageously similar hard-faced rolls, such as metal rolls. A similar arrangement is on both sides of the web W in such a manner that the rolls 1*a* and 1*b* on opposite sides of the web W are located against each other thereby forming a first roll pair, and the rolls 4*a* and 4*b* on the opposite sides of the web W are located against each other, thus forming a second roll pair. The two rolls 1*a* and 4*a* as well as 1*b* and 4*b* on the same side of the web W are located within a particular distance from each other, and a belt 2 is arranged to rotate around the same. The longitudinal direction of the parallel rolls 1*a*, 1*b*, 4*a* and 4*b* equals the width direction of the web W. Between the belts 2 above and below the web W there is a gap, the width of which substantially equals the thickness of the web W passed to the device, wherein only a slight external loading is exerted on the web W. The belts 2 are equally long above and below the web W. It is also possible that the belts in some cases have different lengths. At the location of the rolls, a nip with a great pressing force is not formed between the rolls 1*a* and 1*b* and 4*a* and 4*b* that form the roll pair, but the small externally pressing force is substantially constant on the section of the length of the web that travels through the entire device. Thus, the device has a nip which has a long-term inpact on the web and a small pressing force.

The belt 2 is made of moisture impermeable material with a very smooth surface, which material can be steel or another metal, rubber or plastic. The belt 2 is larger or equal in width with the web W. The parallel rolls 1*a*, 1*b*, 4*a* and 4*b* extend at least over the entire width of the belt 2. The belt 2 can be heated by means of a method known as such, for example with steam, electric resistors or an induction heater. One advantageous manner to adjust the temperature of the belt 2 is the arrangement shown in FIG. 1, in which the belt 2 in a lower temperature is cooled down with water, and the belt 2 in a higher temperature is heated with steam.

In the device one side of paper or paperboard is treated at a time. If both sides are desired to be treated, two successive devices are required, as shown in FIG. 1. The first device F and the second device S shown in the drawing have a substantially similar structure. If in the first device F the temperature of the belt 2 above the web W is $T_1$ and the temperature of the belt 2 below the web W is $T_2$, in the second device S the temperature of the belt 2 above the web W is $T_2$ and the temperature $T_1$ of the belt 2 below the web W is $T_1$.

By means of the method according to the invention, it is possible to produce paper or paperboard with a smooth surface and bulky structure. The treatment of the web is conducted at that processing stage in which the web has suitable moisture content, for example in the end of the drying stage. Thus, suitable moisture content is advantageously 10 to 25%, although the desired effect can be attained in considerably lower moisture contents, in moisture of approximately 6 to 7%. The treatment can also be conducted at an earlier stage, wherein the moisture content of the material to be treated is larger. However, a dense surface prevents moisture evaporation, and thus a larger amount of energy is required for final drying. The method can also be applied for a dry web, wherein the web is moistened again after drying before calendering, as is shown in FIG. 1.

The web W is moistened for example by spraying water from nozzles 3 before the web W is guided to calendering. Water is sprayed on that side of the web which is on the side of the hotter belt of the two belts 2. The moistening can also be conducted by conveying steam on the surface of the web. The vapour pressure inside the web W seeks balance by transferring moisture in a steam flow to the central part the web, and at the same time a pressure is applied on the belt 2 which is in a lower temperature, said pressure resisting the pressure between the belts 2 above and below the web W, thereby maintaining the bulkiness of the web. The surface of the web that is on the side of the hotter belt 2 becomes smoother and it is plastized in a long-term contact against the hotter belt. When the other side of the web is treated, the hotter belt is on the opposite side of the web, when compared to the first treatment. The side that is calendered first maintains its smoothness during the treatment of the other side.

EXAMPLE 1

Figure 2:
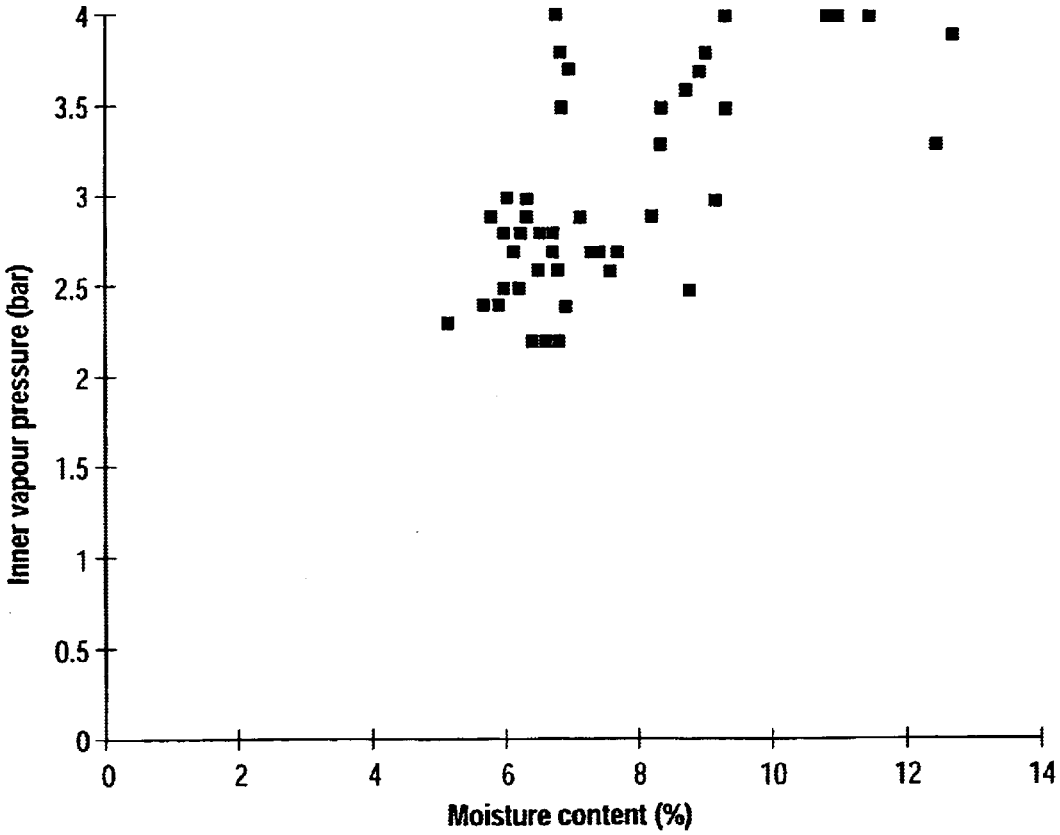
FIG. 2 illustrates the vapour pressure inside the web as a function of the moisture content when measured with a laboratory device corresponding to the device according to FIG. 1.

FIG. 2 and Table 1 show the increase in inner vapour pressure as a function of the moisture content of the web. In Table 1 slashes separate the inner vapour pressures measured in the same moisture content. The inner vapour pressure is measured by means of a pressure sensor of a static laboratory device, which pressure sensor is attached to the belt below the web. The static laboratory device is based on similar principles as the device shown in FIG. 1, but the smooth belt remains stationary therein. When the humidity of the web was between 5 to 13%, the inner vapour pressure varied between 2 to 4 bar.

TABLE 1

Inner vapour pressure as a function of moisture content.

| Moisture content (%) | Inner vapour pressure (bar) |
|---|---|
| 5.1 | 2.3 |
| 5.6 | 2.4 |
| 5.7 | 2.9 |
| 5.8 | 2.4 |
| 5.9 | 2.5/2.8/2.8/3.0 |
| 6.0 | 2.7 |
| 6.1 | 2.5/2.8 |
| 6.2 | 2.9/3.0 |
| 6.3 | 2.2 |
| 6.4 | 2.6/2.8 |
| 6.5 | 2.8/2.2 |
| 6.6 | 2.8/2.7/4.0 |
| 6.7 | 2.6/3.5/3.8/2.2 |
| 6.8 | 3.7/2.4 |
| 7.0 | 2.9 |
| 7.2 | 2.7 |
| 7.3 | 2.7 |
| 7.5 | 2.6 |
| 7.6 | 2.7 |
| 8.1 | 2.9 |
| 8.2 | 3.5/3.3 |
| 8.6 | 3.6 |
| 8.7 | 2.5 |
| 8.8 | 3.7 |
| 8.9 | 3.8 |
| 9.1 | 3.0 |
| 9.2 | 3.5/4.0 |
| 10.7 | 4.0 |
| 10.8 | 4.0 |
| 11.3 | 4.0 |
| 12.3 | 3.3 |
| 12.5 | 3.9 |

EXAMPLE 2

Paperboard with the grammage of 230 g/m$^2$, was calendered by means of a device according to FIG. 1 which contains two successive devices. The length of one device was 8 metres, which is the distance between the outermost point in the periphery of the rolls 1*a* and 1*b* in the travel direction of the web W on the side of the entrance direction of the web W and the outermost point in the periphery of the rolls 4*a* and 4*b* in the travel direction of the web W on the side of the exit direction of the web. In the first device F, the temperature of the belt 2 above the web W was 160° C., and the temperature of the belt 2 below the web W 100° C. In the second device S, the temperature of the belt 2 above the web W was 100° C. and the temperature of the belt 2 below the web W 160° C. Before the first device, the upper surface of the web W was moistened in such a manner, that a slight delay occurred between the moistening and the calendering. The moistening was conducted by spraying water from the nozzles 3.

The web W was passed through the first device F, whereafter the lower surface of the web was moistened in a similar manner as the upper surface before the first device, and the web W was passed through the second device. The amount of water used for moistening in each moistening occasion was small, approximately 5 g/m$^2$. During the experiment, the aim was to maintain the press pressure prevailing in the device between the belts 2 as small as possible, and it was 0.5 bar during the entire section of the web which was located between the belts 2. The running speed of the web was 600 m/min. By means of calendering, an optimal result was attained, which produced a smooth surface and bulky paperboard. The bulkiness of the produced paperboard typically varied between 1.8 to 2.0 cm$^3$/g and the Bendtsen roughness between 300 to 800 ml/min.

The invention is not restricted to the description above, but the invention may vary within the scope of the claims. The temperature of the belts of the calendering device of the paper or paperboard can be adjusted within a wide range, and the temperatures of the belts of successive devices can be different from those presented above. Especially, when two-sidedness is desired in the treatment, the temperatures $T_1$ and/or $T_2$ are different in successive belt pairs in the device according to FIG. 1.

The device implementing the method can differ from the one presented above. The device can, for example, be composed of a hot cylinder and a belt rotation which form a slightly pressing nip through which the paper or paperboard web travels. The press of the nip must be such that the web obtains a sufficient contact with the cylinder. The overlap angle to the hot cylinder is advantageously 180°. The belt forming the belt rotation can be made of polymer material or metal. The essential aspect is that the paper or paperboard web is calendered by utilizing the vapour pressure inside a moist paper or paperboard web in such a manner that the thickness of the web to be calendered is only slightly re-duced, or it is even increased when compared to the thickness before calendering.

What is claimed is:

1. A method for calendaring a moist paper or paperboard web made with pulp, comprising the steps of:

moving the moist paper or paperboard web under a slight external pressing pressure through a long nip formed between two smooth, moisture impermeable counter surfaces from which at least one is heated, and a first surface of the web is in contact with the first counter surface and a second surface of the web is in contact with the second counter surface, wherein the first counter surface has a first temperature of at least 100° C. and the second counter surface has a second temperature which is higher than the first temperature and at least 160° C., the web being moved in such a way that the second surface of the web is calendered during traveling between the first counter suface and the second counter suface by the contact with the second counter surface; and wherein the web is calendered during traveling between the first counter surface and the second counter surface such that the web has an inner vapour pressure inside the moist paper or paperboard web which is increased due to the heating of the web and the restriction of the evaporation of moisture from the web by means of the first counter suface and the second counter suface, said inner vapour pressure acting to resist resisting the slight pressing pressure between the the first counter surface and the second counter surfaces, thus counteracting reduction of the thickness of the paper or paperboard web during calendering.

2. The method of claim 1 wherein the vapour pressure inside the paper or paperboard web is reduced by allowing the web to cool down when it is in contact with one of the counter surfaces.

3. The method of claim 1, wherein fines of the paper or paperboard, or pigment mixed in the pulp is transferred into the surface of the web by means of the vapour pressure inside the web.

4. The method of claim 1, wherein the first surface of the web is calendered by:

moving the moist paper or paperboard web under a slight external pressing pressure through a second long nip formed between two smooth, moisture impermeable counter surfaces from which at least one is heated, and the second surface of the web is in contact with the first counter surface and the first surface of the web is in contact with the second counter surface;

wherein the first counter surface has a first temperature of at least 100° C. and the second counter surface has a second temperature which is higher than the first temperature and at least 160° C. in such a way that the first surface of the web is calendered during traveling between the first counter surface and the second counter surface by the contact with the second counter surface.

5. A device for calendering a moist paper or paperboard web comprising:

a first smooth moisture impermeable counter surface having a first temperature of at least 100° C.; and a second smooth moisture impermeable counter surface having a second temperature which is at least 160° C. and higher than the first temperature, and forming with the first counter surface a long nip through which the web to be calendered is arranged to travel under a slight external pressing pressure, wherein at least one of the first counter surface and the second counter surface is heated, and wherein a first surface of the web is in contact with the first counter surface and a second surface of the web is in contact with the second counter surface, such that the second surface of the web is calendered during travel between the counter surfaces by the contact with the second counter surface and the web has an inner vapour pressure inside the moist paper or paperboard web which is increased due to the heating of the web and the restriction of the evaporation of moisture from the web by the counter surfaces, said inner vapour pressure resisting the slight pressing pressure between the smooth counter surfaces thus counteracting reduction of the thickness of the web during calendering.

6. The device of claim 5 wherein each smooth counter surface is formed by a belt arranged to rotate around at least two rolls.

7. The device of claim 6 wherein each belt is made of a metal material.

8. The device of claim 6 wherein a gap whose width equals the thickness of the web remains between the belts.

9. A device for calendering a paper or board web comprising:

a first roll;

a second roll spaced a first distance from the first roll;

a third roll defining a first roll pair with the first roll;

a fourth roll spaced the first distance from the third roll, and forming a second roll pair with the second roll;

a first belt which rotates about the first roll and the second roll, the first belt defining a first smooth moisture impermeable counter surface having a first temperature of at least 100° C.;

a second belt which rotates about die third roll and the fourth roll, the second belt defining a second smooth moisture impermeable counter surface having a second temperature which is at least 160° C. and higher than the first temperature, the second counter surface forming with the first counter surface a long nip through which the web travels under a slight external pressing pressure, wherein at least one of the first counter surface and the second counter surface is heated, and wherein a first surface of the web is in contact with the first counter surface and a second surface of the web is in contact with the second counter surface, such that the second surface of the web is calendered during travel between the counter surfaces by the contact with the second counter surface and the web has an inner vapour pressure which is increased due to the heating of the web mid the restriction of the evaporation of moisture from the web by the counter surfaces, said inner vapour pressure resisting the slight pressing pressure between the smooth counter surfaces thus counteracting reduction of the thickness of the web during calendering.

10. The device of claim 9 further comprising a second device comprising:

a second device first roll;

a second device second roll spaced a second device first distance from the second device first roll;

a second device third roll defining a second device first roll pair with the second device first roll;

a second device fourth roll spaced the second device first distance from the second device third roll, and forming a second device second roll pair with the second device second roll;

a second device first belt rotates about the second device first roll and the second device second roll, the second device first belt defining a second device first smooth moisture impermeable counter surface having a second device first temperature of at least 100° C.;

a second device second belt which rotates about the second device third roll and the second device fourth roll, the second device second belt defining a second device second temperature which is at least 160° C. and higher than the second device first temperature, the second device second counter surface forming with the second device first counter surface a long nip through which the web travels under a slight external pressing pressure, wherein at least one of the second device first counter surface and the second device second counter surface is heated, and wherein the second surface of the web is in contact with the second device first counter surface and a first surface of the web is in contact with the second device second counter surface, such that the first surface of the web is calendered during travel between the second device counter surfaces by the contact with the second device second counter surface and the web has an inner vapour pressure which is increased due to the heating of the web and the restriction of the evaporation of moisture from the web by the second device counter surfaces, said inner vapour pressure resisting the slight pressing pressure between the smooth counter surfaces thus counteracting reduction of the thickness of the web during calendering.

11. The device of claim 9 wherein each belt is made of a metal material.

12. The device of claim 9 wherein a gap whose width equals the thickness of the web remains between the belts.

* * * * *

UNITED STATES PATENT AND TRADEMARK OFFICE

CERTIFICATE OF CORRECTION

PATENT NO. : 6,779,440 B2
DATED : August 24, 2004
INVENTOR(S) : Pekka Koivukunnas et al.

It is certified that error appears in the above-identified patent and that said Letters Patent is hereby corrected as shown below:

Title page,
Item [75], Inventors, the first name should be -- Pekka Koivukunnas --

Column 6,
Line 61, "resist resisting the" should be -- resist the --

Column 8,
Line 1, "die" should be -- the --
Line 41, before "temperature" insert -- smooth moisture impermeable counter surface having a second device second --

Signed and Sealed this

Fourteenth Day of December, 2004

JON W. DUDAS
*Director of the United States Patent and Trademark Office*